US008104992B2

(12) United States Patent
Biodrowski

(10) Patent No.: US 8,104,992 B2
(45) Date of Patent: Jan. 31, 2012

(54) CONCRETE SCREED APPARATUS

(76) Inventor: Richard Biodrowski, Fort Calhoun, NE (US)

( * ) Notice: Subject to any disclaimer, the term of this patent is extended or adjusted under 35 U.S.C. 154(b) by 283 days.

(21) Appl. No.: 12/589,158

(22) Filed: Oct. 19, 2009

(65) Prior Publication Data

US 2011/0091277 A1 Apr. 21, 2011

(51) Int. Cl.
*E01C 19/22* (2006.01)

(52) U.S. Cl. ..... 404/118

(58) Field of Classification Search ..... 404/112, 404/114, 118, 120, 133.1, 133.2, 133.05, 404/101, 103, 117, 122, 124, 119; 15/235.4, 15/235.5, 235.8
See application file for complete search history.

(56) References Cited

U.S. PATENT DOCUMENTS

| | | | | |
|---|---|---|---|---|
| 2,813,466 | A | 11/1957 | Torgerson | |
| 2,897,735 | A | 8/1959 | Alessio | |
| 3,090,984 | A * | 5/1963 | Dunnigan | 15/235.4 |
| 3,936,210 | A * | 2/1976 | Oehlerking | 404/89 |
| 4,386,901 | A | 6/1983 | Morrison | |
| 4,449,845 | A | 5/1984 | Carrillo | |
| 4,591,291 | A * | 5/1986 | Owens | 404/118 |
| 4,641,995 | A * | 2/1987 | Owens | 404/118 |
| 4,752,156 | A | 6/1988 | Owens | |
| 4,828,427 | A | 5/1989 | Nisenbaum | |
| 4,838,730 | A * | 6/1989 | Owens | 404/114 |
| 5,016,319 | A * | 5/1991 | Stigen | 16/426 |
| 5,980,154 | A * | 11/1999 | Record | 404/97 |
| 6,089,787 | A * | 7/2000 | Allen et al. | 404/118 |
| 6,705,799 | B2 * | 3/2004 | Piccoli | 404/97 |
| 6,981,819 | B1 * | 1/2006 | Suckow et al. | 404/114 |
| 7,052,204 | B2 * | 5/2006 | Lutz | 404/118 |
| 2006/0018713 | A1 | 1/2006 | Rouillard | |
| 2010/0202831 | A1 * | 8/2010 | Saranga | 404/75 |
| 2010/0239368 | A1 * | 9/2010 | Lickel | 404/84.5 |

* cited by examiner

*Primary Examiner* — Thomas Will
*Assistant Examiner* — Abigail A Risic
(74) *Attorney, Agent, or Firm* — Dennis L. Thomte; Thomte Patent Law Office LLC

(57) ABSTRACT

A concrete screed apparatus is provided which may be used by a pair of workers, each of whom has the screed apparatus mounted to one of their legs or feet. The screed apparatus enables concrete to be easily screeded and properly finished without the workers doing the same on their knees or bending from the waist. The screed apparatus is adapted to move a screed board back and forth across the concrete to be finished which is also vibrated as it is being screeded.

27 Claims, 5 Drawing Sheets

CONCRETE SCREED APPARATUS

BACKGROUND OF THE INVENTION

1. Field of the Invention

This invention relates to a concrete screed apparatus and more particularly to a concrete screed apparatus which is preferably used by a pair of spaced-apart workers, wherein each of the workers have a concrete screed apparatus operatively secured to a leg of the worker so that the two workers may screed concrete.

2. Description of the Related Art

When concrete is being poured and finished, a pair of workers are normally positioned at the opposite ends of a screed board with the screed board being moved back and forth to level the concrete. Usually, the workers must perform the screeding operation while on their knees or in a kneeling position which is extremely tiresome and difficult.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A concrete screed apparatus is disclosed for use by each of a pair of workers who are finishing concrete. Each of the concrete screed apparatuses comprises a first support adapted to be secured to the lower leg of the worker. An elongated second support, having inner and outer ends, is provided with the inner end of the second support being pivotally secured, about a horizontal axis, to the first support whereby the outer end of the second support may be vertically moved with respect to its inner end. The apparatus of this invention also includes a third support, having upper and lower ends, with the lower end of the third support being pivotally secured about a horizontal axis transverse to the longitudinal axis of the second support. The upper end of the third support has a hand gripping portion thereon which may be grasped by the worker. A fourth support is longitudinally movably mounted on the second support. Means is provided for selectively moving the fourth support along the length of the second support. A screed support is pivotally secured to the fourth support about a horizontal axis which is parallel to the longitudinal axis of the second support. An elongated screed or screed board is secured to the screed support whereby the longitudinal axis of the screed is transverse to the longitudinal axis of the second support.

In the preferred embodiment, the third support is length adjustable and includes a power cylinder for adjusting the length of the third support. In the preferred embodiment, the invention includes an electronic vibrator which operatively connected to the screed for vibrating the screed. In the preferred embodiment, the electronic vibrator is operatively secured to the fourth support. Further, the apparatus includes a solenoid actuated clamp for securing the screed to the screed support.

In the preferred embodiment, the inner end of the second support is vertically adjustably secured to the first support. Also, in the preferred embodiment, a laser beam apparatus is operatively secured to the first support which directs a horizontal laser beam from the first support towards the outer end of the second support. Preferably, a control mechanism is mounted on the first support for controlling the movement of the screed relative to the second support. In the preferred embodiment, a second concrete screed apparatus is operatively connected to the screed so that a pair of workers who are horizontally spaced apart may perform the concrete finishing operation.

Therefore, it is a principal object of the invention to provide an improved concrete screed apparatus.

It is a further object of the invention to provide a concrete screed apparatus which is utilized by a pair of horizontally spaced-apart workers.

A further object of the invention is to provide a concrete screed apparatus which includes a first support which is operatively secured to the lower leg of a worker and which has an elongated support pivotally secured thereto, about a horizontal axis, and which extends therefrom.

Still another object of the invention is to provide a concrete screed apparatus including means for raising and lowering the screed.

Another object of the invention is to provide a concrete screed apparatus which is vertically adjustably secured to a boot or the like in which the worker has his/her foot positioned.

Still another object of the invention is to provide a concrete screed apparatus which includes a vibrator, laser beam and means for moving the screed board back and forth relative to the workers.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
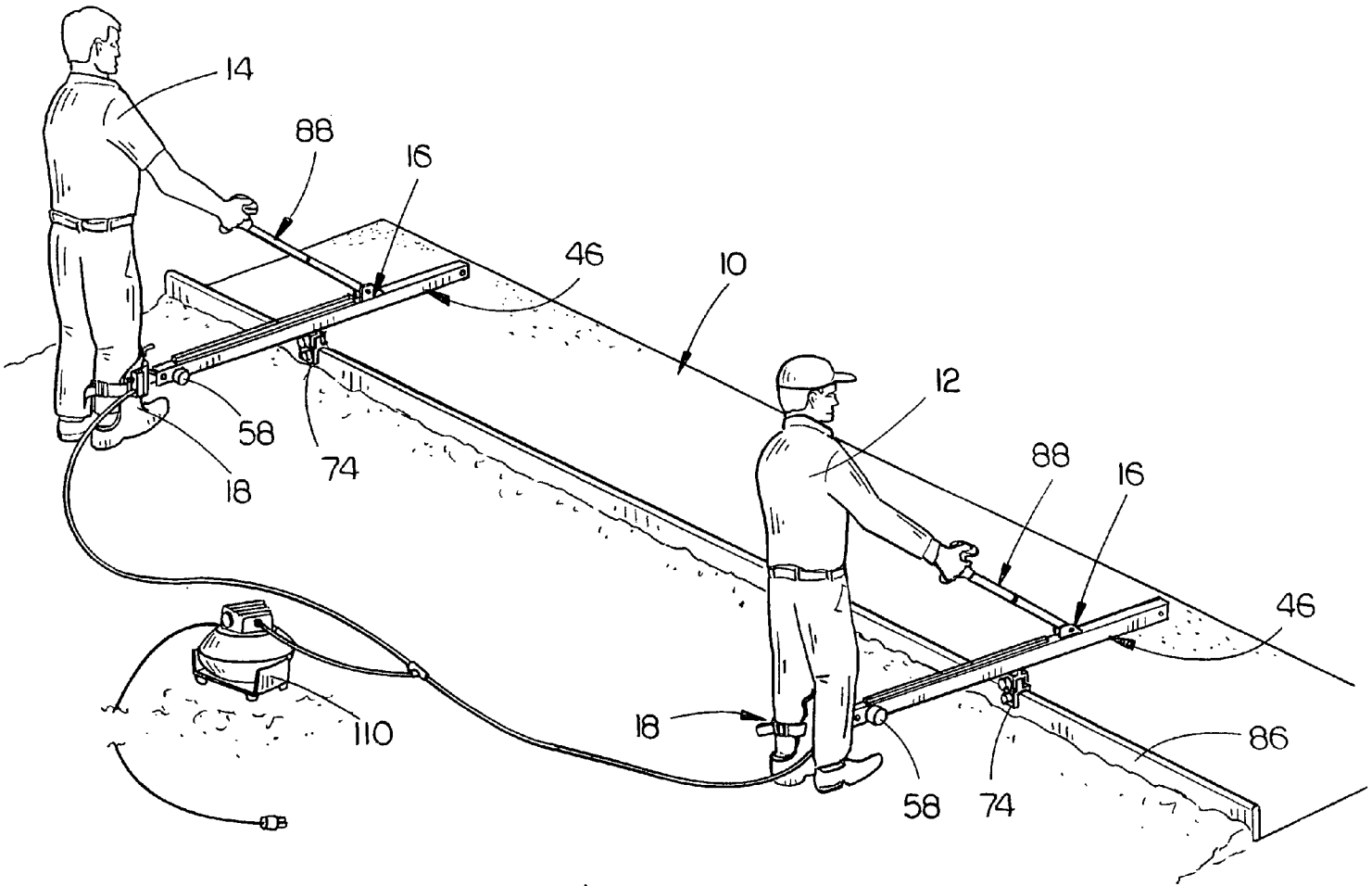
FIG. 1 is a perspective view illustrating a pair of workers utilizing a pair of the apparatuses of this invention.
Figure 2:
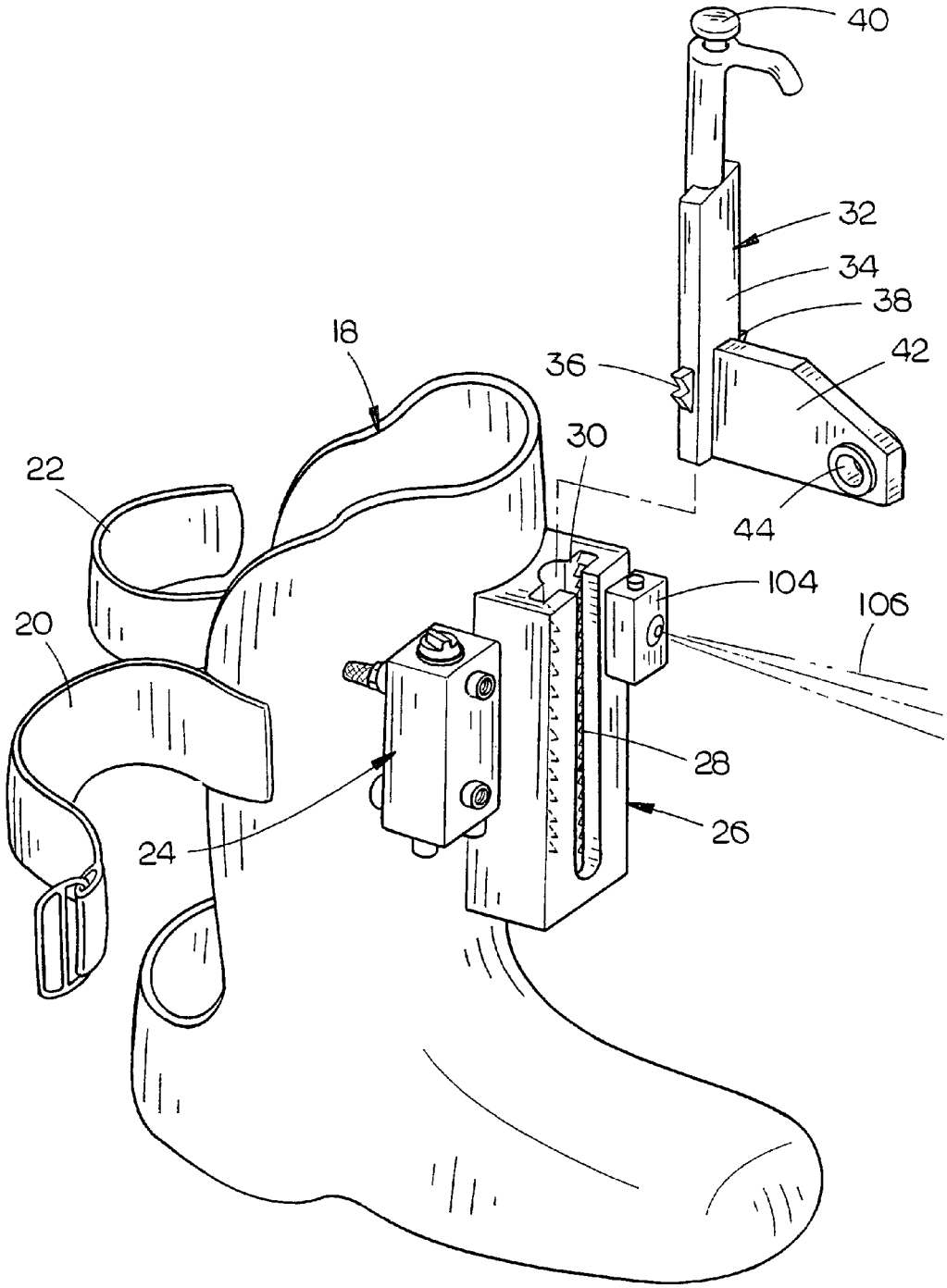
FIG. 2 is a partial perspective view illustrating the support which is attached to the worker's lower leg and foot.
Figure 3:
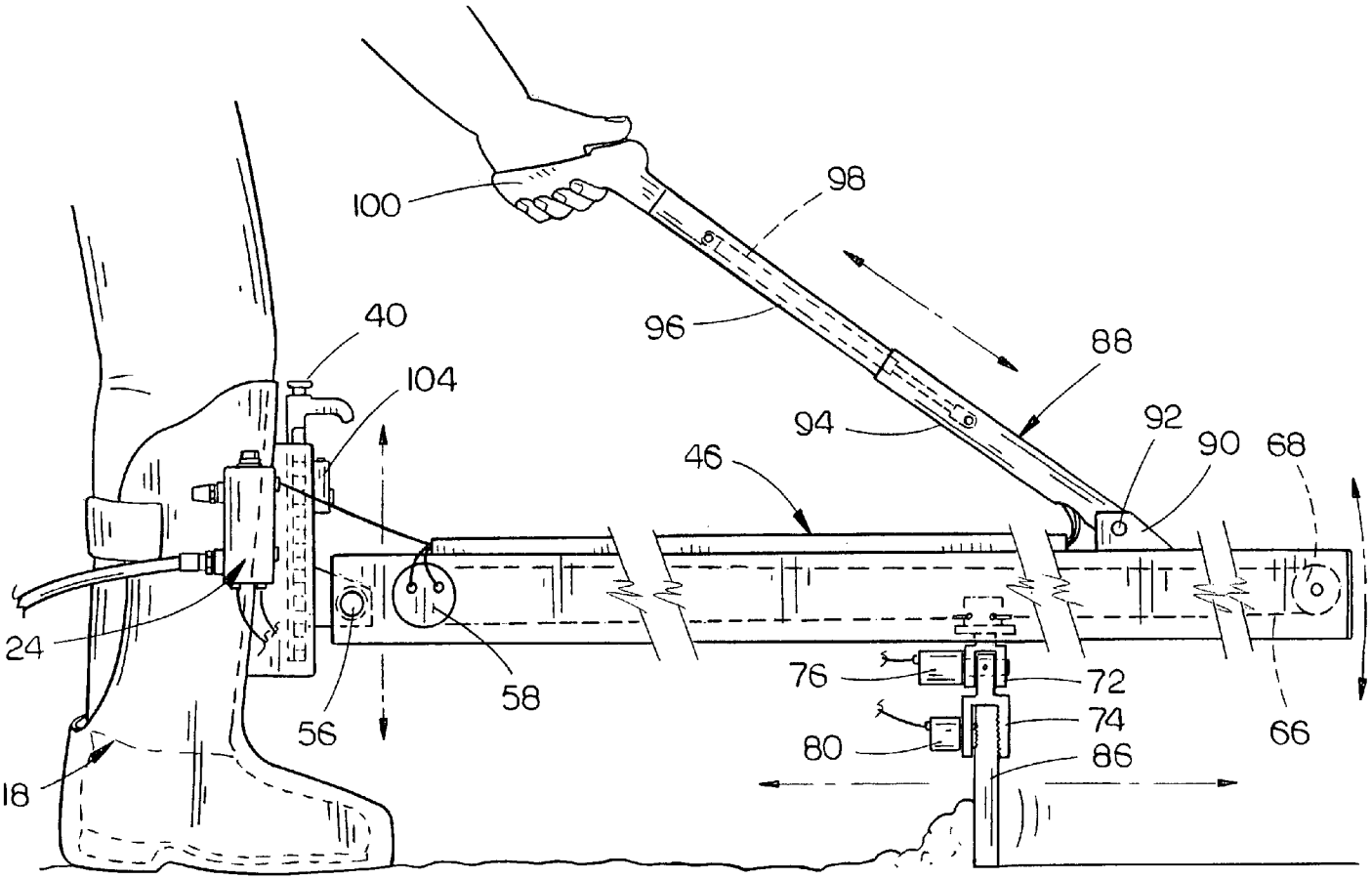
FIG. 3 is a side elevational view of the apparatus of this invention.
Figure 4:
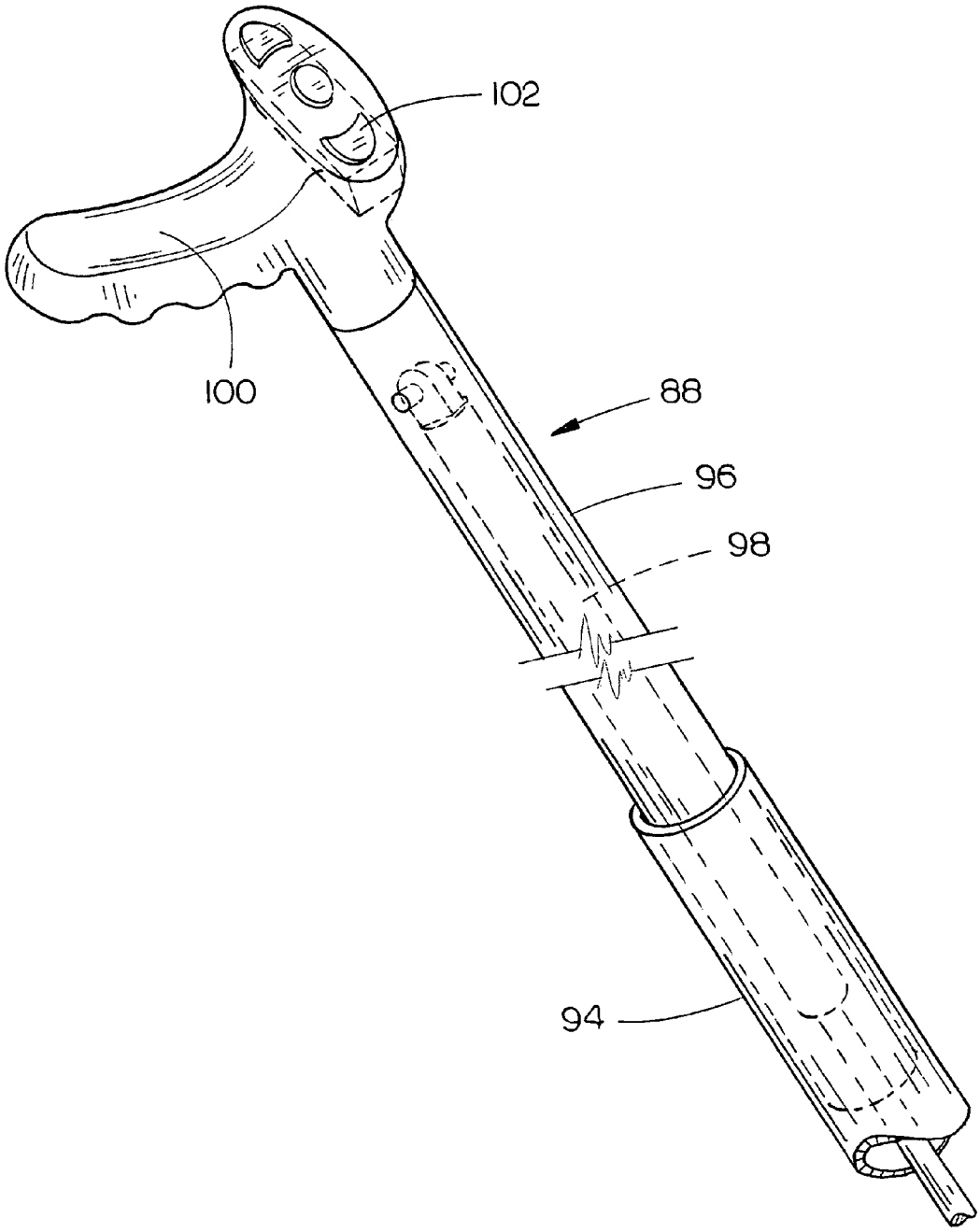
FIG. 4 is a perspective elevational view illustrating the length adjustable and hand held support.

In FIG. 1, the numeral 10 refers to concrete which has been poured and which is being screeded by a pair of workers 12 and 14 which are horizontally spaced-apart. Each of the workers 12 and 14 has a concrete screed apparatus 16 associated therewith for screeding the concrete 10.

Apparatus 16 includes a first support 18 in the form of a boot or shoe into which the worker places his/her lower leg and foot. Preferably, a pair of straps 20 and 22 are utilized to securely position the worker's leg in the support 18.

The numeral 24 refers to a control valve which is mounted on the support 18 for supplying air to various components of the invention. A vertically disposed support 26 is also secured to the support 18 and has a vertically disposed gear rack 28 associated with a channel 30 into which a vertically adjustable device 32 may be positioned in a vertically adjustable manner. The device 32 includes a flat bar 34 which is received by the channel 30 with the gear teeth 36 and 38 extending laterally therefrom which are selectively movable into contact with the gear rack 28 by means of the vertically movable actuator 40. Bracket 42 is secured to the lower end of bar 34 and extends therefrom and has a hollow bushing or opening 44 formed in the outer end thereof.

The numeral 46 refers to an elongated second support having an inner end 48 and an outer end 50. The support 46 is channel-shaped in cross section and has a pair of longitudinally extending grooves or channels 52 and 54 formed in the interior thereof. The inner end 48 of support 46 is pivotally secured to the bushing 44 by means of pin 56 which extends through the inner end of the support 46 and through the bushing 44. The numeral 58 refers to an air motor having a drive shaft or power shaft 60 extending inwardly through the opening 62 formed in support 46 with the motor 58 being secured to the support 46 by any convenient means. A pulley 64 is mounted on the shaft 60 within support 46 for rotation therewith and has a drive belt or cable 66 extending therearound. A pulley 68 is also mounted in the interior of support 46 at the outer end of the support 46 and is rotatably mounted on the shaft 70 with the cable 66 extending around pulley 68.

Figure 5:
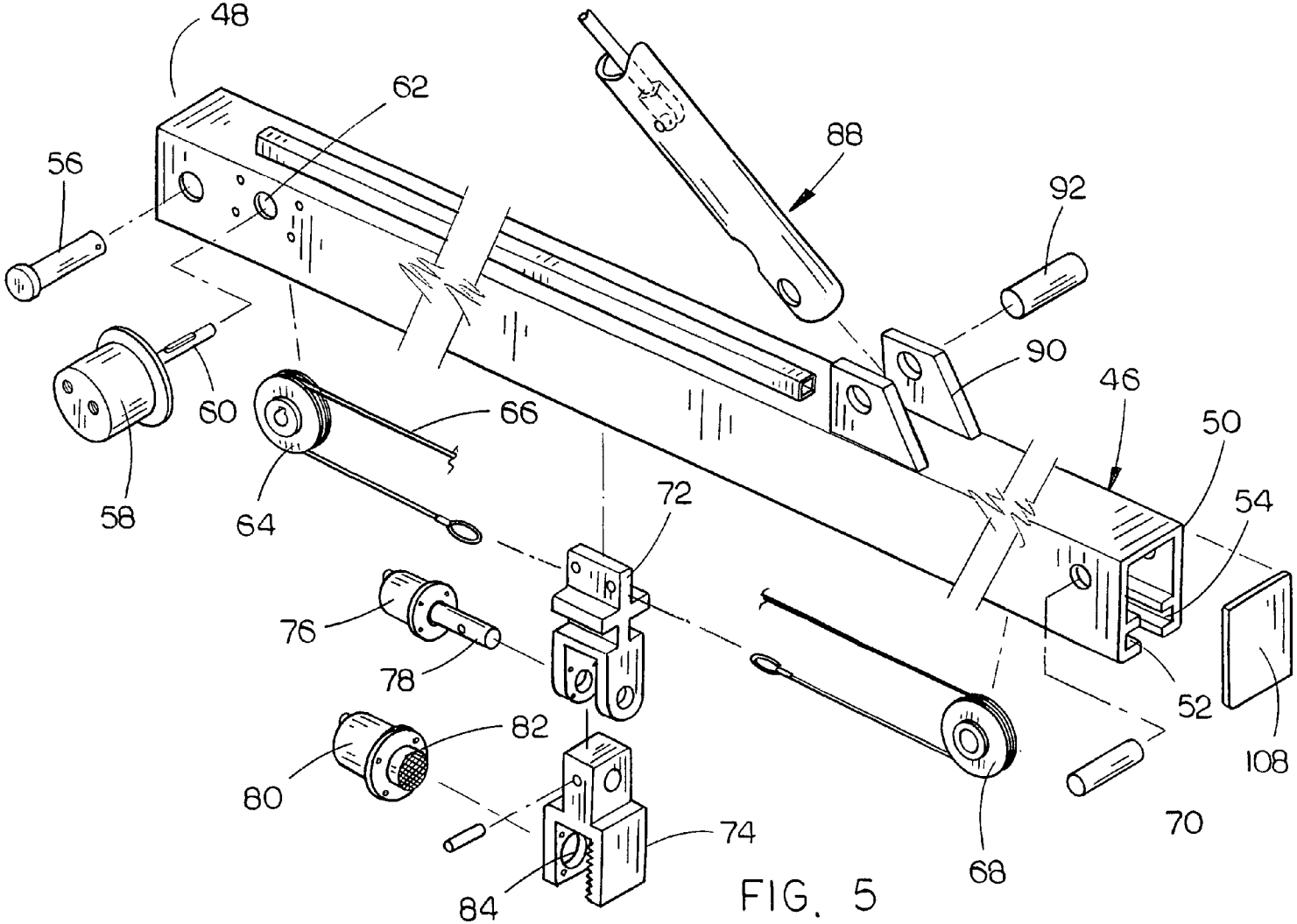
FIG. 5 is an exploded perspective view of a portion of the apparatus.

The free ends of cable 66 are secured to a support 72 which is longitudinally slidably mounted in the channels 52 and 54. The numeral 74 refers to a support which is pivotally secured to the support 72 about an axis which is parallel to the longitudinal axis of support 46. An air actuated vibrator 76 having a shaft 78 extending therefrom pivotally connects the support 74 to the support 72 as illustrated in FIG. 5. The numeral 80 refers to an air actuated clamp device which is secured to support 74 and which has a clamping member 82 extending therefrom which extends through opening 84 in support 74. The numeral 86 refers to an elongated screed or screed board which is clamped into the support 74.

The numeral 88 refers to an elongated telescopic support 88, the lower end of which is pivotally secured to bracket 90 mounted on support 46 by means of pivot pin 92. Support 88 preferably includes telescopic sections 94 and 96 which are telescopically moved with respect to one another by means of a power cylinder or electric actuator rod 98. Support 88 includes a hand gripping portion 100 at its upper end. Controls 102 are provided in the hand gripping portion 100 for controlling the extension and retraction of the support 88 and various other functions of the components.

Preferably, a battery operated laser beam apparatus 104 is secured to the member 26 and directs a laser beam 106 horizontally therefrom to aid the workers in leveling the concrete being screeded. Preferably, the outer end of support 46 is closed by a cap 108. Air for the various components is, provided by a remote unit 110.

Thus it can be seen that a novel concrete screed apparatus has been provided which ideally suited for use by a pair of workers to screed fresh concrete to finish the same. The workers may move the screed apparatus by moving their legs and the outer ends of the supports 46 may be moved vertically through the use of the support 88. The screed board 86 is easily moved towards and away from the workers by means of the motor 58. The vibrator 76 vibrates the screed board 86 back and forth much like the workers must normally manually do. Therefore, it can be seen that a novel apparatus has been provided which relieves the workers from their back bending and laborious task of screeding concrete by hand.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A concrete screed apparatus, for use by a worker, comprising:

a first support adapted to be secured to the lower leg of the worker;

an elongated second support having inner and outer ends;

said inner end of said second support being pivotally secured, about a horizontal axis, to said first support whereby said outer end of said second support may be vertically moved with respect to its said inner end;

an elongated third support having upper and lower ends;

said lower end of said third support being pivotally secured, about a horizontal axis transverse to the longitudinal axis of said third support;

said upper end of said third support having a hand gripping portion thereon which may be grasped by the worker;

a fourth support longitudinally movably mounted on said second support;

means for moving said fourth support along the length of said second support;

a screed support pivotally secured to said fourth support about a horizontal axis which is parallel to the longitudinal axis of said second support;

and an elongated screed secured to said screen support whereby the longitudinal axis of said screed is transverse to the longitudinal axis of said second support.

2. The apparatus of claim 1 wherein said third support is length adjustable.

3. The apparatus of claim 2 further including a power cylinder for adjusting the length of said third support.

4. The apparatus of claim 3 wherein said third support is telescopic.

5. The apparatus of claim 1 further including an electronic vibrator operatively connected to said screed for vibrating said screed.

6. The apparatus of claim 5 wherein said electronic vibrator is operatively secured to said fourth support.

7. The apparatus of claim 1 further including a powered clamp for securing said screed to said screed support.

8. The apparatus of claim 1 wherein said inner end of said second support is vertically adjustably secured to said first support.

9. The apparatus of claim 1 further including a laser beam apparatus operatively secured to said first support which directs a horizontal laser beam from said first support towards said outer end of said second support.

10. The apparatus of claim 1 wherein said first support comprises a boot into which the worker inserts his/her foot and leg.

11. The apparatus of claim 1 wherein a motor driven cable system moves said fourth support relative to said second support.

12. The apparatus of claim 1 wherein a control valve is mounted on said first support.

13. The apparatus of claim 1 further including a second concrete screed apparatus for use by a second worker which is operatively connected to said screed.

14. A means for screeding concrete including first and second concrete screeding apparatuses for use by first and second workers with each of the first and second concrete screeding apparatuses comprising:

a first support adapted to be secured to the lower leg of the worker;

an elongated second support having inner and outer ends;

said inner end of said second support being pivotally secured, about a horizontal axis, to said first support whereby said outer end of said second support may be vertically moved with respect to its said inner end;

an elongated third support having upper and lower ends;

said lower end of said third support being pivotally secured, about a horizontal axis transverse to the longitudinal axis of said third support;

said upper end of said third support having a hand gripping portion thereon which may be grasped by the worker;

a fourth support longitudinally movably mounted on said second support;

means for moving said fourth support along the length of said second support;

a screed support pivotally secured to said fourth support about a horizontal axis which is parallel to the longitudinal axis of said second support;

and an elongated screed secured to said screen support whereby the longitudinal axis of said screed is transverse to the longitudinal axis of said second support.

15. The means of claim 14 wherein said third support is length adjustable.

16. The means of claim 15 further including a power cylinder for adjusting the length of said third support.

17. The means of claim 16 wherein said third support is telescopic.

18. The means of claim 16 further including an electronic vibrator operatively connected to said screed for vibrating said screed.

19. The means of claim 18 wherein said electronic vibrator is operatively secured to said fourth support.

20. The means of claim 14 further including a powered clamp for securing said screed to said screed support.

21. The means of claim 14 wherein said inner end of said second support is vertically adjustably secured to said first support.

22. The means of claim 14 further including a laser beam means operatively secured to said first support which directs a horizontal laser beam from said first support towards said outer end of said second support.

23. The means of claim 14 wherein said first support comprises a boot into which the worker inserts his/her foot and leg.

24. The means of claim 14 wherein a motor driven cable system moves said fourth support relative to said second support.

25. The means of claim 14 wherein a control valve is mounted on said first support.

26. A concrete screed apparatus, for use by a worker, comprising:

a first support;

an elongated second support having inner and outer ends;

said inner end of said second support being pivotally secured, about a horizontal axis, to said first support whereby said outer end of said second support may be vertically moved with respect to its said inner end;

an elongated third support having upper and lower ends;

said lower end of said third support being pivotally secured, about a horizontal axis transverse to the longitudinal axis of said third support;

said upper end of said third support having a hand gripping portion thereon which may be grasped by the worker;

a fourth support longitudinally movably mounted on said second support;

means for moving said fourth support along the length of said second support;

a screed support pivotally secured to said fourth support about a horizontal axis which is parallel to the longitudinal axis of said second support;

and an elongated screed secured to said screen support whereby the longitudinal axis of said screed is transverse to the longitudinal axis of said second support.

27. A means for screeding concrete including first and second concrete screeding apparatuses for use by first and second workers with each of the first and second concrete screeding apparatuses comprising:

a first support;

an elongated second support having inner and outer ends;

said inner end of said second support being pivotally secured, about a horizontal axis, to said first support whereby said outer end of said second support may be vertically moved with respect to its said inner end;

an elongated third support having upper and lower ends;

said lower end of said third support being pivotally secured, about a horizontal axis transverse to the longitudinal axis of said third support;

said upper end of said third support having a hand gripping portion thereon which may be grasped by the worker;

a fourth support longitudinally movably mounted on said second support;

means for moving said fourth support along the length of said second support;

a screed support pivotally secured to said fourth support about a horizontal axis which is parallel to the longitudinal axis of said second support;

and an elongated screed secured to said screen support whereby the longitudinal axis of said screed is transverse to the longitudinal axis of said second support.

* * * * *